US009411318B2

(12) United States Patent
Kobayashi

(10) Patent No.: US 9,411,318 B2
(45) Date of Patent: Aug. 9, 2016

(54) ELECTRONIC TIMEPIECE AND TIME DIFFERENCE CORRECTION METHOD

(71) Applicant: SEIKO EPSON CORPORATION, Tokyo (JP)

(72) Inventor: Naohiro Kobayashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/661,150

(22) Filed: Mar. 18, 2015

(65) Prior Publication Data

US 2015/0268635 A1 Sep. 24, 2015

(30) Foreign Application Priority Data

Mar. 24, 2014 (JP) ..... 2014-059911

(51) Int. Cl.

| | |
|---|---|
| ***G04C 3/00*** | (2006.01) |
| ***G04C 9/00*** | (2006.01) |
| ***G04R 20/00*** | (2013.01) |
| ***G04G 5/00*** | (2013.01) |

(52) U.S. Cl.
CPC *G04C 3/001* (2013.01); *G04C 9/00* (2013.01); *G04G 5/00* (2013.01); *G04R 20/00* (2013.01)

(58) Field of Classification Search
CPC ..... G04C 3/00; G04C 3/001; G04C 9/00; G04G 5/00; G04G 5/04; G04G 5/007; G04R 20/00; G04R 60/14
See application file for complete search history.

(56) References Cited

U.S. PATENT DOCUMENTS 4,044,545 A * 8/1977 Shimizu ..... G04G 21/08 368/22
4,396,294 A * 8/1983 Yoshida ..... G04C 3/008 386/191
4,779,247 A * 10/1988 Uchida ..... G04G 9/0076 368/22
5,408,444 A * 4/1995 Kita ..... G04R 20/06 368/47
6,579,004 B1 * 6/2003 Kim ..... G04B 19/23 368/21
2006/0133216 A1 * 6/2006 Zachmann ..... G04C 3/146 368/80
2011/0205855 A1 * 8/2011 Salzmann ..... G04C 9/00 368/185
2011/0216630 A1 * 9/2011 Shimizu ..... G04C 9/00 368/185
2013/0064045 A1 * 3/2013 Essery ..... H04W 88/02 368/47
2014/0092714 A1 * 4/2014 Nagareda ..... G04C 3/14 368/187

FOREIGN PATENT DOCUMENTS

JP 2006-153655 A 6/2006

* cited by examiner

*Primary Examiner* — Amy Cohen Johnson
*Assistant Examiner* — Matthew Powell
(74) *Attorney, Agent, or Firm* — Global IP Counselors, LLP

(57) ABSTRACT

When an operation button is pressed for three seconds, a second hand is reversed and fast-forwarded to the position of a currently set time difference. After the second hand stops, the second hand is moved stepwise to time difference display positions to continuously display time difference correction candidates. In this state, when the operation button is pressed, the second hand is caused to stop, and an hour hand is moved to the position of time determined in consideration of the time difference at which the second hand points. The time difference at which the second hand points is stored as a time difference set value, and an action mode is switched to a normal time display mode for time-difference time display based on the time difference set value.

5 Claims, 12 Drawing Sheets

| TIME DIFFERENCE DISPLAY POSITION | TIME DIFFERENCE FROM UTC | TIME ZONE/REPRESENTATIVE CITY NAME |
|---|---|---|
| 0 SECONDS | ±0 HOURS | LONDON |
| 3 SECONDS | +1 HOUR | PARIS/BERLIN |
| 5 SECONDS | +2 HOURS | CAIRO |
| 8 SECONDS | +3 HOURS | MOSCOW |
| 10 SECONDS | +4 HOURS | DUBAI |
| 13 SECONDS | +5 HOURS | KARACHI |
| 15 SECONDS | +6 HOURS | DHAKA |
| 18 SECONDS | +7 HOURS | BANGKOK |
| 20 SECONDS | +8 HOURS | HONG KONG |
| 23 SECONDS | +9 HOURS | TOKYO |
| 25 SECONDS | +10 HOURS | SYDNEY |
| 28 SECONDS | +11 HOURS | NOUMEA |
| 30 SECONDS | +12 HOURS | WELLINGTON |
| 32 SECONDS | +13 HOURS | DST IN WELLINGTON |
| 33 SECONDS | -11 HOURS | MIDWAY |
| 35 SECONDS | -10 HOURS | HONOLULU |
| 38 SECONDS | -9 HOURS | ANCHORAGE |
| 40 SECONDS | -8 HOURS | LOS ANGELES |
| 43 SECONDS | -7 HOURS | DENVER |
| 45 SECONDS | -6 HOURS | CHICAGO |
| 48 SECONDS | -5 HOURS | NEW YORK |
| 50 SECONDS | -4 HOURS | CARACAS |
| 53 SECONDS | -3 HOURS | RIO DE JANEIRO |
| 55 SECONDS | -2 HOURS | DST IN RIO DE JANEIRO |
| 58 SECONDS | -1 HOUR | AZORES ISLANDS |

FIG. 5

| TIME DIFFERENCE DISPLAY POSITION | TIME DIFFERENCE FROM UTC | TIME ZONE/REPRESENTATIVE CITY NAME |
|---|---|---|
| 0 SECONDS | ±0 HOURS | LONDON/UTC |
| 1 SECOND | +1 HOUR | PARIS/BERLIN |
| 2 SECONDS | +2 HOURS | CAIRO |
| 3 SECONDS | +3 HOURS | JIDDA |
| 4 SECONDS | +4 HOURS | DUBAI |
| 5 SECONDS | +5 HOURS | KARACHI |
| 6 SECONDS | +6 HOURS | DHAKA |
| 7 SECONDS | +7 HOURS | BANGKOK |
| 8 SECONDS | +8 HOURS | BEIJING |
| 9 SECONDS | +9 HOURS | TOKYO |
| 10 SECONDS | +10 HOURS | SYDNEY |
| 11 SECONDS | +11 HOURS | NOUMEA |
| 12 SECONDS | +12 HOURS | WELLINGTON |
| 13 SECONDS | +13 HOURS | (DST IN WELLINGTON) |
| 49 SECONDS | -11 HOURS | MIDWAY ISLAND |
| 50 SECONDS | -10 HOURS | HONOLULU |
| 51 SECONDS | -9 HOURS | ANCHORAGE |
| 52 SECONDS | -8 HOURS | LOS ANGELES |
| 53 SECONDS | -7 HOURS | DENVER |
| 54 SECONDS | -6 HOURS | CHICAGO |
| 55 SECONDS | -5 HOURS | NEW YORK |
| 56 SECONDS | -4 HOURS | SANTIAGO |
| 57 SECONDS | -3 HOURS | RIO DE JANEIRO |
| 58 SECONDS | -2 HOURS | (DST IN RIO DE JANEIRO) |
| 59 SECONDS | -1 HOUR | AZORES ISLANDS |

FIG. 11

ELECTRONIC TIMEPIECE AND TIME DIFFERENCE CORRECTION METHOD

BACKGROUND

1. Technical Field

The present invention relates to an electronic timepiece having a time difference correction function and to a time difference correction method.

2. Related Art

There is a known electronic timepiece of related art having a function of correcting a time difference through operation of a crown, a switch, or any other component. In an electronic timepiece of this type, there is a proposed technology for replacing a time difference of, for example, one hour with one second and moving the second hand in accordance with the number of operations of the switch to a position within a range from a 0-second position to a 13-second position or a position within a range from the 0-second position to a 49-second position to determine a time difference set value (JP-A-2006-153655, for example).

In the method described in JP-A-2006-153655, however, when it is desired to change, for example, a time difference of 0 hours to a time difference of +9 hours, the switch needs to be pressed 9 times. The number of operations of pressing the switch therefore increases as the time difference increases.

SUMMARY

An advantage of some aspect of the invention is to provide an electronic timepiece capable of reliably correcting a time difference with a small number of operations.

An electronic timepiece according to an aspect of the invention includes a display section, an input section, a time difference correction control section that performs time difference correction in accordance with an input placed at the input section, and a time display control section that causes the display section to display time-difference time produced by adding a time difference set value to current time, and the time difference correction control section causes the display section to continuously display a plurality of time difference correction candidates when the input is placed once at the input section, whereas when the input is placed again at the input section, the time difference correction control section corrects the time difference set value to a time difference of the time difference correction candidate displayed when the input is placed again.

According to the aspect of the invention, the time difference correction control section performs time difference correction when an input is placed at the input section. When the input is placed once at the input section, the time difference correction control section causes the display section to continuously display a plurality of time difference correction candidates in response to the input placed once. When the input is placed again at the input section, the time difference correction control section corrects the time difference set value to the time difference of the time difference correction candidate displayed when the input is placed again. As a result, the time display control section adds the corrected time difference set value to the current time and causes the display section to display the accurate time-difference time. In the aspect of the invention described above, even when a large time difference is considered, target time difference correction candidates are displayed when the input is placed once, whereby the time difference correction operation can be improved in terms of convenience.

In the electronic timepiece described above, the display section may include a time indicating hand and time display markings, and the time difference correction control section may move the time indicating hand stepwise to the positions of the time display markings to cause the time indicating hand to display the time difference correction candidates. In this case, a user is allowed to reliably recognize the time difference correction candidates, whereby the time difference correction operation can be improved in terms of convenience.

In the electronic timepiece described above, the display section may include a time indicating hand and time display markings, and the time difference correction control section may continuously move the time indicating hand in such a way that the time indicating hand points at the time display markings to cause the time indicating hand to display the time difference correction candidates. In this case as well, target time difference correction candidates are displayed when the input is placed once, whereby the time difference correction operation can be improved in terms of convenience.

In the electronic timepiece described above, the input placed at the input section may include a first input and a second input having aspects different from each other, and when the input is the first input, the time difference correction control section may cause the display section to continuously display the plurality of time difference correction candidates in response to the input placed once, whereas when the input is the second input, the time difference correction control section may cause the display section to display one of the time difference correction candidates in response to the input placed once. In this case, when a large time difference is considered, target time difference correction candidates can be displayed in response to the first input made once, whereas when a small time difference is considered, target time difference correction candidates can be quickly displayed in response to the second input made once, whereby the time difference correction operation can be improved in terms of convenience.

A time difference correction method according to another aspect of the invention includes causing a display section to display time-difference time produced by adding a time difference set value to current time, performing time difference correction in accordance with an input placed at an input section, and causing the display section to continuously display a plurality of time difference correction candidates when the input is placed once at the input section, whereas when the input is placed again at the input section, correcting the time difference set value to a time difference of the time difference correction candidate displayed when the input is placed again.

BRIEF DESCRIPTION OF THE DRAWINGS

The invention will be described with reference to the accompanying drawings, wherein like numbers reference like elements.

FIG. 5 shows an example of a time difference table in the electronic timepiece.

FIG. 11 shows an example of a time difference table in the variation of the invention.

DESCRIPTION OF EXEMPLARY EMBODIMENTS

Figure 1:
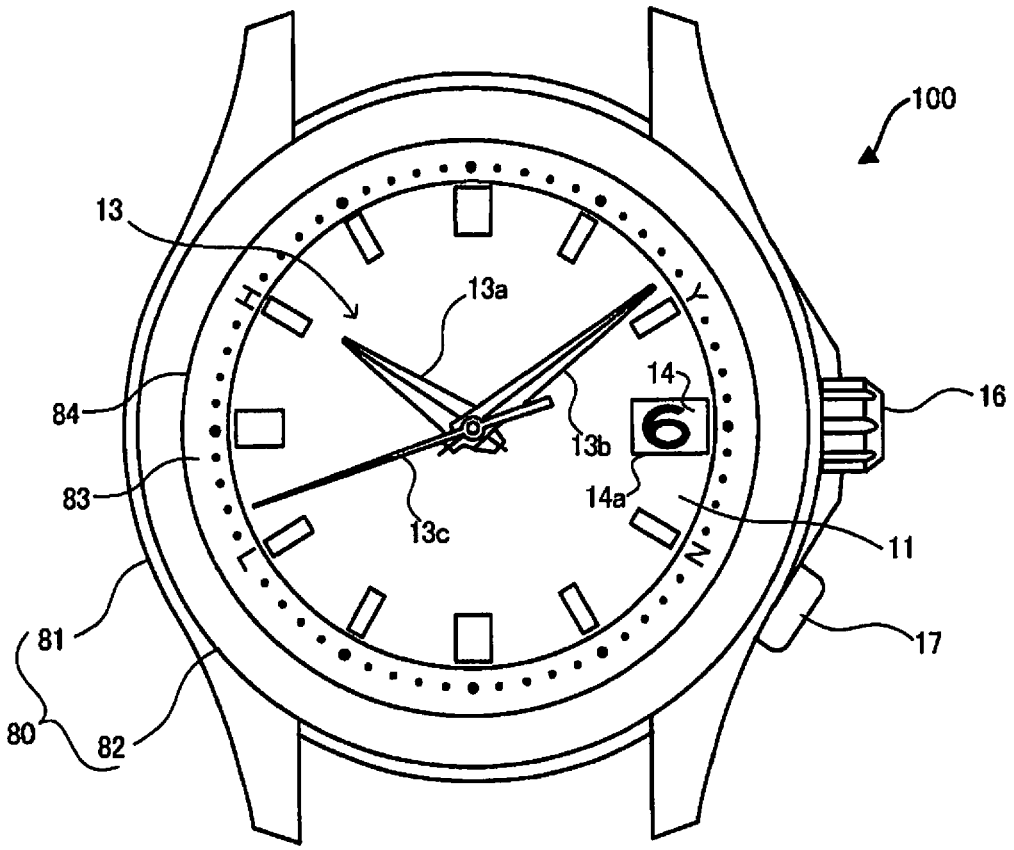
FIG. 1 is a plan view of an electronic timepiece according to a first embodiment of the invention.

Preferable embodiments of the invention will be described below in detail with reference, for example, to the accompanying drawings. It is noted in the drawing that the dimension and scale of each portion differ from an actual dimension and scale thereof as appropriate. Further, each embodiment described below is a preferable specific example of the invention, and a variety of technically preferable restrictions are therefore imposed thereon. The scope of the invention is, however, not limited to the embodiments unless otherwise particularly stated in the following description that a limitation is imposed on the invention.

First Embodiment

A: Overview of Electronic Timepiece

A first embodiment of the invention will first be described with reference to FIGS. 1 to FIGS. 7A to 7E. FIG. 1 shows an electronic timepiece 100 in the first embodiment of the invention. The electronic timepiece 100 is a solar-driven, radio-wave-based correction timepiece that is driven with electric power generated by a solar panel and receives a standard radio wave for time correction.

The electronic timepiece 100 includes an exterior case 80. The exterior case 80 is formed of a cylindrical case barrel 81 made of a metal material and a bezel 82 made of a ceramic or metal material and fit into the case barrel 81. In the present embodiment, the exterior case is formed of two parts, and the exterior case may instead be formed of one part.

A disk-shaped dial 11 is disposed as a time display portion inside the inner circumference of the bezel 82 via a ring-shaped dial ring 83 made of a plastic material, and time indicating hands 13, which display time, date, and other types of information, are disposed on the dial 11. The time indicating hands 13 are formed of an hour hand 13*a*, a minute hand 13*b*, and a second hand 13*c*. A date recognition window 14*a* is formed as an opening through the dial 11, and the date displayed on a date indicator 14 is visible through the date recognition window 14*a*.

The front-side opening of the exterior case 80 is blocked with a cover glass plate 84 via the bezel 82, and the dial 11 and the time indicating hands 13 (hour hand 13*a*, minute hand 13*b*, and second hand 13*c*) inside the exterior case 80 are visible through the cover glass plate 84.

The electronic timepiece 100 is so configured that manual operation of a crown 16 allows manual time correction and manual operation of an operation button 17 allows an action mode to be switched between a normal time display mode and a time difference correction mode. The time difference correction mode will be described later in detail. The electronic timepiece 100 according to the present embodiment has a time correction function of daily automatic reception of the standard radio wave for time correction. The standard radio wave can instead be forcibly received through manual operation of the operation button 17.

B. Circuit Configuration of Electronic Timepiece

Figure 2:
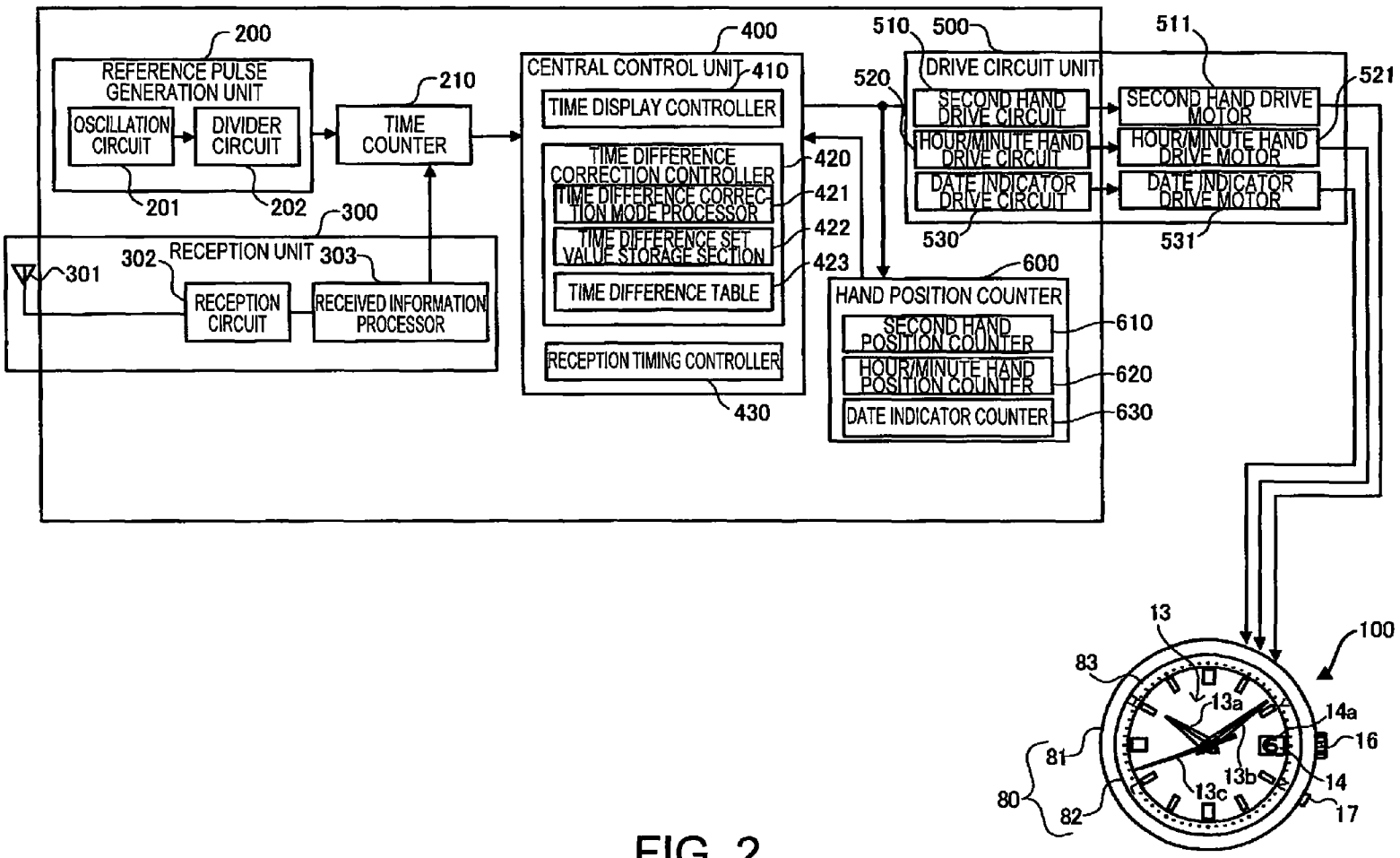
FIG. 2 is a block diagram showing a circuit configuration of the electronic timepiece.

FIG. 2 shows a circuit configuration of the electronic timepiece 100. The electronic timepiece 100 has a circuit including a reference pulse generation unit 200, a time counter 210, a reception unit 300, a central control unit 400, a hand position counter 600, and a drive circuit unit 500, as shown in FIG. 2.

The reference pulse generation unit 200 includes an oscillation circuit 201, which causes a quartz oscillator to oscillate to produce reference oscillation, and a divider circuit 202, which divides the reference oscillation from the oscillation circuit 201 to produce a clock pulse, a fast-forwarding pulse, and other types of pulse.

The time counter 210 counts current time (reference time) based on the clock pulse from the divider circuit 202. The time counter 210 includes a second counter (not shown) that counts second information on the second that forms time, a minute/hour counter (not shown) that counts minute/hour information on the hour and the minute that form the time, and a day counter (not shown) that counts day information.

The reception unit 300 includes an antenna 301, which receives a radio wave, a reception circuit 302, which processes a signal carried by the radio wave received by the antenna 301, and a received information processor 303, which processes information from the reception circuit 302. The reception circuit 302 includes an amplification circuit, a bandpass filter, a demodulation circuit, an AGC (automatic gain control) circuit, and a decoding circuit, neither of which is shown. Time information received and signal-processed in the reception circuit 302 is outputted to the received information processor 303.

The received information processor 303 identifies the type of the received standard radio wave to recognize a region from which the standard radio wave has been emitted and reads the time information in accordance with a time code format associated with the standard radio wave. The received information processor 303 further temporarily stores the received time information and evaluates whether or not the time information and successively received time information have a predetermined time difference (one-minute difference) to determine whether the reception has been successful. When the reception has been successful, the received information processor 303 corrects the current time information from the time counter 210 based on the received time information. It is noted that the reception circuit 302 starts the time information reception based on a preset schedule (automatic reception time) or through forcible reception operation performed on the operation button 17.

The central control unit 400 includes a time display controller 410, which controls time display action performed by the time indicating hands 13, a time difference correction controller 420, which controls time difference setting action, and a reception timing controller 430, which controls the reception action performed by the reception unit 300.

The time display controller 410 causes the time indicating hands 13 to display the current time counted by the time counter 210. When time difference correction that will be described later is performed, the time display controller 410 causes the time indicating hands 13 to display time-difference time produced by adding a time difference set value stored in a time difference set value storage section 422 to the current time counted by the time counter 210. That is, the time display controller 410 functions as a time display control section that causes a display section to display the time-difference time produced by adding the time difference set value to the current time.

A control signal outputted from the time display controller 410 is outputted to the drive circuit unit 500, and at the same time, the same control signal is outputted to the hand position counter 600.

The time difference correction controller 420 includes a time difference correction mode processor 421, which performs action in the time difference correction mode, a time difference set value storage section 422, which stores a time difference set value set as a result of the time difference correction or a time difference set value in an initial setting, and a time difference table 423, which records time differences in a plurality of regions.

When the operation button 17 is pressed for a predetermined period, the time difference correction mode processor 421 terminates the time display action performed by the time display controller 410 and switches the action mode from the normal time display mode to the time difference correction mode. That is, the operation button 17 functions as an input section, and the time difference correction mode processor 421 functions as a time difference correction control section that performs time difference correction in accordance with an input placed at the input section.

In a state in which the action mode is switched to the time difference correction mode, the time difference correction mode processor 421 outputs a control signal that drives the second hand 13*c* to a time difference display position to the drive circuit unit 500 and the hand position counter 600 to control the drive operation of the second hand 13*c* for time difference display control, which will be described later in detail.

The time difference set value storage section 422 stores a time difference set value set as a result of time difference correction or a time difference set value in the initial setting and outputs the stored time difference set value to the time difference correction mode processor 421 and the time display controller 410. When the time difference is set hourly, the time difference set value storage section 422 can be formed of an hourly counter by way of example.

The time difference table 423 stores time difference display positions and time differences in a one-to-one relationship, as shown, for example, in FIG. 5. In the example shown in FIG. 5, the time difference display positions are positions which are defined by replacing a time difference of one hour with three or two seconds and to which the secondhand is moved clockwise from a 0-second position. In this case, the range from the 0-second position to a 32-second position includes positive time differences, and the range from a 33-second position to a 58-second position includes negative time differences. For example, when the time difference is +2 hours, the second hand 13*c* is moved to a 5-second position, and when the time difference is −2 hours, the second hand 13*c* is moved to a 55-second position.

The reception timing controller 430 stores automatic reception start time at which the reception unit 300 starts reception of the standard radio wave. When the time reaches the automatic reception start time, the reception timing controller 430 activates the reception circuit 302 to cause it to start the reception of the standard radio wave. The automatic reception time is set at 2 AM and 4 AM on a daily basis by way of example. The reception timing controller 430 further causes the reception circuit 302 to start the reception of the standard radio wave in accordance with a forcible reception start instruction inputted when the operation button 17 is pressed.

The drive circuit unit 500 includes a second hand drive circuit 510 and a second hand drive motor 511, which drive the second hand 13*c*, an hour/minute hand drive circuit 520 and an hour/minute hand drive motor 521, which drive the hour hand 13*a* and the minute hand 13*b*, and a date indicator drive circuit 530 and a date indicator drive motor 531, which drive the date indicator 14.

In the drive circuit unit 500, the drive circuits 510, 520, and 530 output drive pulses according to control signals outputted from the central control unit 400 to the drive motors 511, 521, and 531 to drive the hour hand 13*a*, the minute hand 13*b*, the second hand 13*c*, and the date indicator 14.

The hand position counter 600 includes a second hand position counter 610, which counts the position of the second hand 13*c* and stores the position, an hour/minute hand position counter 620, which counts the positions of the hour hand 13*a* and the minute hand 13*b* and stores the positions, and a date indicator counter 630, which counts the amount of rotation of the date indicator 14 and stores the amount of rotation.

When the central control unit 400 outputs the control signals that drive the hour hand 13*a*, the minute hand 13*b*, the second hand 13*c*, and the date indicator 14 toward the drive circuit unit 500, the control signals are outputted also to the hand position counter 600 at the same time. The hand position counter 600 increments the counters 610, 620, and 630 based on the control signals and stores the amounts of rotation of the hour hand 13*a*, the minute hand 13*b*, the second hand 13*c*, and the date indicator 14.

In the initial setting, the counts of the hand position counter 600 are allowed to coincide with the positions of the hour hand 13*a*, the minute hand 13*b*, the second hand 13*c*, and the date indicator 14, and the hand position counter 600 is then incremented whenever the central control unit 400 outputs the control signals to the driver circuit unit 500, whereby the positions of the hour hand 13*a*, the minute hand 13*b*, the second hand 13*c*, and the date indicator 14 are allowed to coincide with the counts of the hand position counter 600.

C: Time Difference Correction Mode

Figure 3:
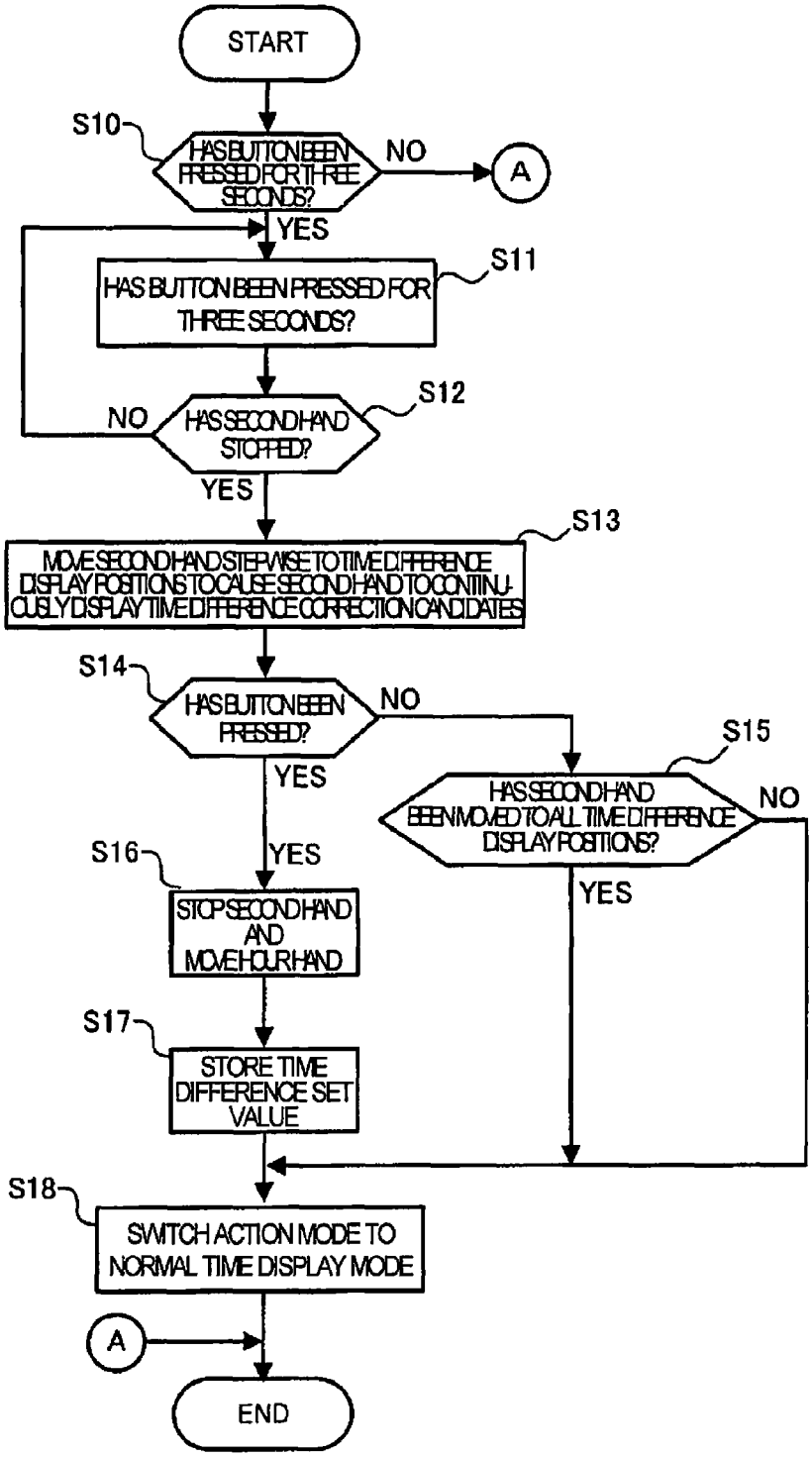
FIG. 3 is a flowchart showing action of the electronic timepiece that performs time difference correction.

The action of the thus configured electronic timepiece 100 that operates in the time difference correction mode will be described with reference to the flowchart in FIG. 3, specific action examples shown in FIGS. 4A to 4E, and the time difference table shown in FIG. 5.

First, when the time display controller 410 performs normal time display control so that the hour hand 13*a*, the minute hand 13*b*, and the second hand 13*c* display time, the time difference correction mode processor 421 evaluates whether the operation button 17 has been pressed for three seconds (step S10). The evaluation is repeatedly performed at predetermined time intervals in response, for example, to an interrupt. In the present embodiment, the action mode is switched to the time difference correction mode when the operation button 17 is pressed for three seconds by way of example. It is, however, noted that the period for which the operation button 17 is pressed, which is a reference in accordance with which the action mode is switched to the time difference correction mode, is not limited to three seconds and can be changed as appropriate.

When a result of the evaluation shows that the operation button 17 has not been pressed for three seconds (NO in step S10), the time difference correction mode processor 421 does not carry out processes in the time difference correction mode. When a result of the evaluation shows that the operation button 17 has been pressed for three seconds (YES in step S10), the time difference correction mode processor 421 switches the action mode to the time difference correction mode. That is, the time difference correction mode processor 421 terminates the time display performed by the time display controller 410, reverses the second hand 13*c*, and fast-forwards the second hand 13*c* to the position where the currently set time difference is displayed (step S11). The time difference correction mode processor 421 reads the time difference set value stored in the time difference set value storage section 422 and further refers to the time difference table 423 to acquire the position where the currently set time difference is displayed.

Figure 4A:
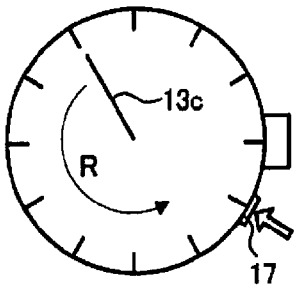
FIGS. 4A to 4E show specific examples of the action of the electronic timepiece that performs the time difference correction.
Figure 4B:
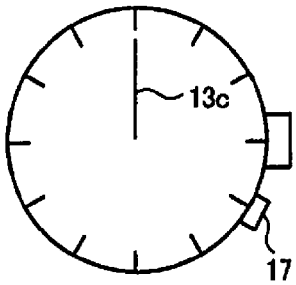

For example, when the second hand 13*c* is located in a 55-second position when the action mode is switched to the time difference correction mode, the time difference correction mode processor 421 reverses the second hand 13*c* in the direction indicated by the arrow R and fast-forwards the second hand 13*c* to the position where the currently set time difference is displayed, as shown in FIG. 4A. As an example, when the currently set time difference is 0 hours and the position where the time difference of 0 hours is displayed is the 0-second position, the second hand 13*c* stops at the 0-second position, as shown in FIG. 4B. A user can therefore grasp the currently set time difference by checking the position where the second hand 13*c* has stopped.

Figure 4C:
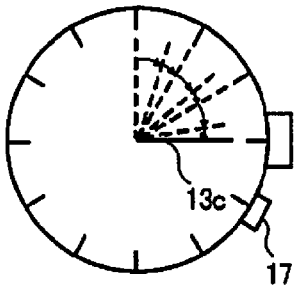

The time difference correction mode processor 421 evaluates whether the second hand 13*c* has stopped (step S12). When a result of the evaluation shows that the second hand 13*c* has not stopped (NO in step S12), the time difference correction mode processor 421 keeps moving the second hand 13*c* to the current time difference position described above. On the other hand, when a result of the evaluation shows that the second hand 13*c* has stopped (YES in step S12), the time difference correction mode processor 421 moves the second hand 13*c* stepwise (stepwise hand movement) to time difference display positions to cause the second hand 13*c* to continuously display time difference correction candidates (step S13). For example, when the second hand 13*c* stops at the 0-second position as shown in FIG. 4B, the second hand 13*c* is moved stepwise to time difference display positions, such as a 3-second position, a 5-second position, an 8-second position, a 10-second position, a 13-second position, and a 15-second position as shown in FIG. 4C, to continuously display time difference correction candidates or, in this case, a time difference of +1 hour, a time difference of +2 hours, a time difference of +3 hours, a time difference of +4 hours, a time difference of +5 hours, and a time difference of +6 hours. In this example, the time difference display positions are positions which are defined by replacing the time difference of one hour with three or two seconds and to which the second hand 13*c* is moved clockwise from the 0-second position. When a positive time difference is considered, the time difference display positions are positions to which the secondhand 13*c* is moved clockwise from the 0-second position to the 32-second position by the amount corresponding to the time difference, whereas when a negative time difference is considered, the second hand 13*c* is moved clockwise from the 33-second position to the 58-second position by the amount corresponding to the time difference. The relationship between time differences and time difference display positions is stored in the time difference table 423.

The interval between the stepwise movements of the secondhand 13*c*, that is, the period for which the secondhand 13*c* is caused to stop at a time difference display position can be set as appropriate, such as one second or two seconds. For example, when the interval between the stepwise movements of the second hand 13*c* is set at one second so that the period for which the second hand 13*c* is caused to stop at a time difference display position is set at one second, the second hand 13*c* is moved in the example shown in FIG. 4C as follows: The second hand 13*c* is caused to start from the 0-second position; after one second, the second hand 13*c* is moved to the 3-second position and caused to stop at the 3-second position for one second; and the second hand 13*c* is then moved to the 5-second position and caused to stop at the 5-second position for one second. The second hand 13*c* is then moved to the 8-second position and caused to stop at the 8-second position for one second. The second hand 13*c* is then moved to the 10-second position and caused to stop at the 10-second position for one second. The second hand 13*c* is then moved to the 13-second position and caused to stop at the 13-second position for one second. The second hand 13*c* is then moved to the 15-second position. The same action is repeated until the second hand 13*c* is moved to the 32-second position, which corresponds to a time difference of +13 hours. The range from the 0-second position to the 32-second position includes positive time differences. After the second hand 13*c* is moved to the 32-second position, which corresponds to the time difference of +13 hours, and caused to stop at the 32-second position for one second, the second hand 13*c* is moved to the 33-second position and caused to stop at the 33-second position for one second. The range from the 33-second position to the 58-second position includes negative time differences. The second hand 13*c* is then moved to a 35-second position and caused to stop at the 35-second position for one second. The second hand 13*c* is then moved to a 38-second position and caused to stop at the 38-second position for one second. The same action is repeated until the second hand 13*c* is moved to the 58-second position, which corresponds to a time difference of −1 hours.

The time difference correction mode processor 421 evaluates whether the operation button 17 has been pressed while moving the second hand 13*c* stepwise to the time difference display positions as described above (step S14). The reason for this is that in the present embodiment, pressing the operation button 17 during the continuous movement of the second hand 13*c* through time difference display positions allows the time difference set value to be corrected to a time difference that the user desires.

When the operation button 17 has not been pressed (NO in step S14), the time difference correction mode processor 421 evaluates whether the second hand 13*c* has been moved to all the time difference display positions (step S15).

When the operation button 17 has not been pressed during the continuous movement of the second hand 13*c* through the time difference display positions (NO in step S14), and the second hand 13*c* has been moved to all the time difference display positions (YES in step S15), the time difference correction mode processor 421 causes the time display controller 410 to start the normal time display and switches the action mode to the normal time display mode (step S18).

Figure 4D:
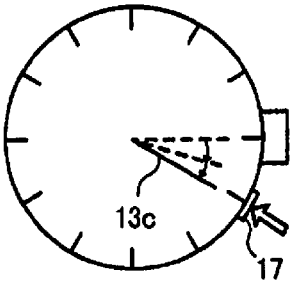
Figure 4E:
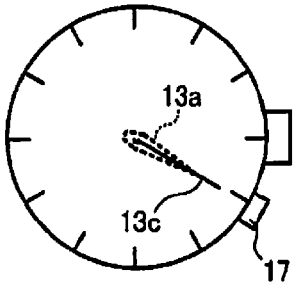

When a result of the evaluation shows that the operation button 17 has been pressed during the continuous movement of the second hand 13*c* through the time difference display positions (YES in step S14), the time difference correction mode processor 421 stops the second hand 13*c* and further moves the hour hand 13*a* to the time difference display position at which the second hand 13*c* points (step S16). FIG. 4D shows an example in which the operation button 17 is pressed when the second hand 13*c* is moved from an 18-second position to a 20-second position. In this case, the second hand 13*c* is caused to stop at the 20-second position, and the hour hand 13*a* is moved to the 20-second position (4-hour position), as shown in FIG. 4E.

The time difference correction mode processor 421 reads the time difference from the time difference display position at which the second hand 13*c* has been caused to stop and stores the read time difference as the time difference set value in the time difference set value storage section 422 (step S17). The time difference correction mode processor 421 then causes the time display controller 410 to start the normal time display and switches the action mode to the normal time display mode (step S18).

As described above, the second hand 13*c* and the dial 11 function as the display section, and the time difference correction mode processor 421 functions as the time difference correction control section that causes the display section to continuously display a plurality of time difference correction candidates when an input is placed once at the input section and corrects, when the input is placed again at the input section, the time difference set value to a time difference indicated by a time difference correction candidate displayed when the input is placed again.

According to the first embodiment having the configuration described above, when the operation button 17 is pressed for three seconds, the action mode is switched to the time difference correction mode, and the second hand 13*c* is then moved stepwise to time difference display positions to continuously display time difference correction candidates without pressing operation of the operation button 17, whereby a desired time difference can be set without pressing the operation button 17 multiple times even when the desired time difference is greater than the currently set time difference. The time difference correction operation can therefore be improved on terms of convenience. Further, since the second hand 13*c* is caused to stop at each time difference display position for a predetermined period, the user can reliably recognize the displayed time difference, whereby a desired time difference can be reliably set.

Second Embodiment

A second embodiment of the invention will be described with reference to FIG. 6 and FIGS. 7A to 7E. In the first embodiment, the description has been made of the case where the secondhand 13*c* is moved stepwise to time difference display positions (stepwise hand movement) to continuously display time difference correction candidates in the time difference correction mode. The present embodiment differs from the first embodiment in that the second hand 13*c* is continuously moved (sweep hand movement) to continuously display time difference correction candidates.

Figure 6:
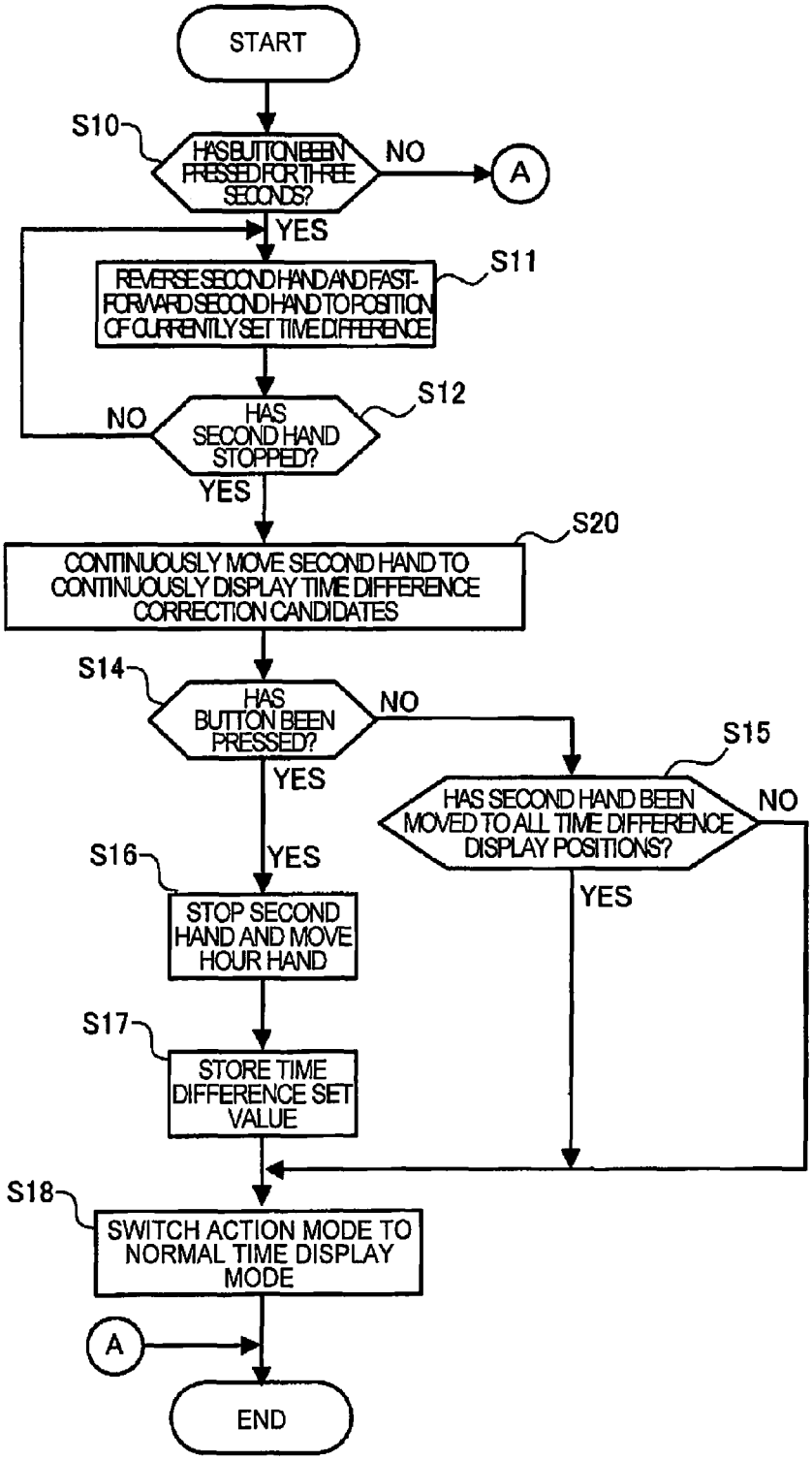
FIG. 6 is a flowchart showing action of an electronic timepiece according to a second embodiment of the invention that performs time difference correction.

FIG. 6 is a flowchart of the action in the time difference correction mode in the present embodiment. In FIG. 6, the same processes as those in the first embodiment have the same step numbers. In the present embodiment, the process in step S13 shown in FIG. 3 is replaced with the process in step S20.

When a result of the evaluation shows that the second hand 13*c* has stopped (YES in step S12), the time difference correction mode processor 421 continuously moves the second hand 13*c* to continuously display the time difference correction candidates (step S20).

Figure 7A:
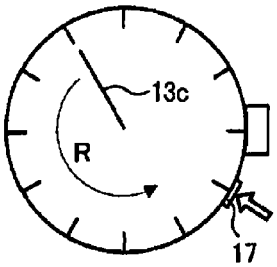
FIGS. 7A to 7E show specific examples of the action of the electronic timepiece that performs the time difference correction.
Figure 7B:
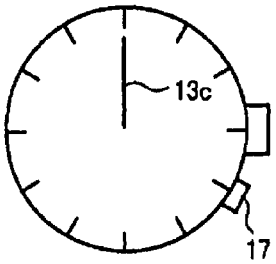
Figure 7C:
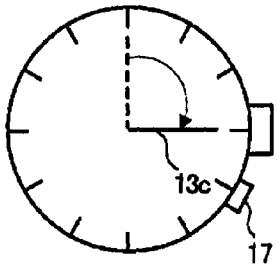

For example, assume now that the second hand 13*c* is reversed and starts moving counterclockwise to the position of the currently set time difference as shown in FIG. 7A, and that the second hand 13*c* stops at the 0-second position as shown in FIG. 7B. The second hand 13*c* is then continuously moved (sweep hand movement), as shown in FIG. 7C.

Figure 7D:
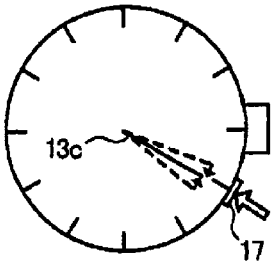
Figure 7E:
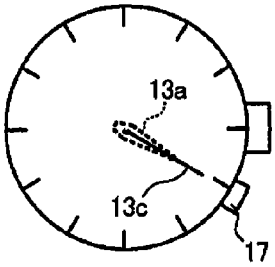

In this case, the operation button 17 is possibly pressed before the second hand 13*c* reaches a time difference display position or after the second hand 13*c* passes the time difference display position, as indicated by the dotted lines in FIG. 7D. In this case, when a result of the evaluation in step S14 shows that the operation button 17 has been pressed, the second hand 13*c* only needs to be forcibly moved to a time difference display position closer to the position of the second hand 13*c* and caused to stop at the time difference display position (step S16). The hour hand 13*a* is then moved to the time difference display position, as in the first embodiment (step S16). The other processes, which will not be described, are the same as those in the first embodiment.

In the present embodiment as well, when the operation button 17 is pressed for three seconds, the action mode is switched to the time difference correction mode, and the second hand 13*c* is then continuously and smoothly moved through time difference display positions without pressing operation of the operation button 17, whereby a desired time difference can be set without pressing the operation button 17 multiple times even when the desired time difference is greater than the currently set time difference. The time difference correction operation can therefore be readily performed.

Third Embodiment

A third embodiment of the invention will be described with reference to FIG. 8. In the first embodiment, the description has been made of the case where after the action mode is switched to the time difference correction mode and the second hand 13*c* stops at the position of the currently set time difference, the second hand 13*c* is moved stepwise to time difference display positions to continuously display time difference correction candidates. The present embodiment differs from the first embodiment in that after the action mode is switched to the time difference correction mode and the second hand 13*c* stops at the position of the currently set time difference, pressing operation of the operation button 17 is further accepted and two types of time difference correction are performed in accordance with the length of the pressing operation period.

Figure 8:
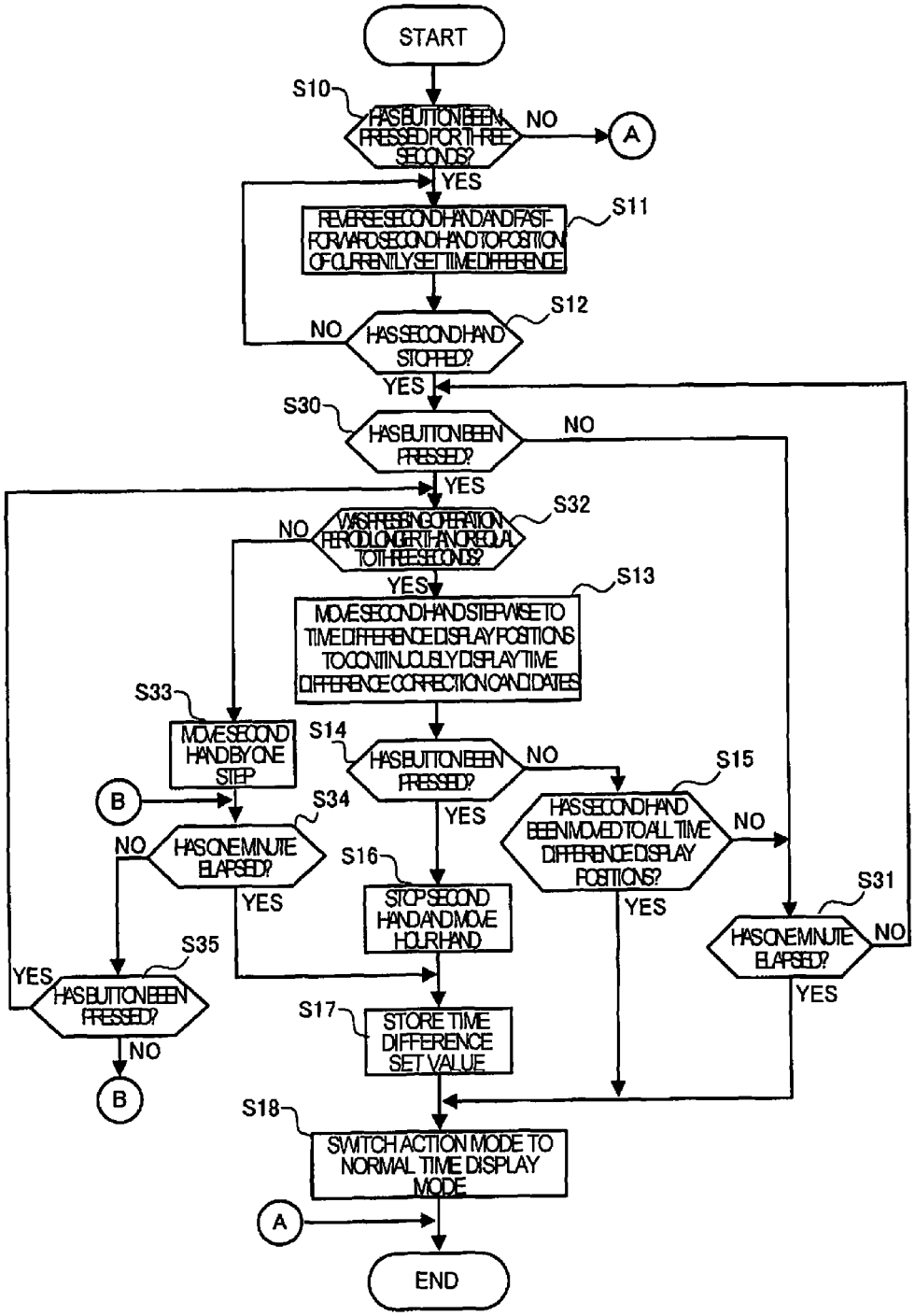
FIG. 8 is a flowchart showing action of an electronic timepiece according to a third embodiment of the invention that performs time difference correction.

FIG. 8 is a flowchart of the time difference correction mode in the present embodiment. In FIG. 8, the same processes as those in the first embodiment have the same step numbers. In the present embodiment, processes in steps S30 to S35 are added to the processes in the flowchart shown in FIG. 3.

When the action mode is switched to the time difference correction mode and a result of the evaluation shows that the second hand 13*c* has stopped at the position of the currently set time difference (YES in step S12), the time difference correction mode processor 421 evaluates whether the operation button 17 has been pressed again (step S30), as shown in FIG. 8. When the operation button 17 has not been pressed (NO in step S30) but one minute has elapsed (YES in step S31) in this state, the time difference correction mode processor 421 causes the time display controller 410 to start the normal time display and switches the action mode to the normal time display mode (step S18).

On the other hand, when the operation button 17 has been pressed (YES in step S30), the time difference correction mode processor 421 evaluates whether the pressing operation period is longer than or equal to three seconds (step S32). When a result of the evaluation shows that the pressing operation period is shorter than three seconds (NO in step S32), the time difference correction mode processor 421 moves the second hand 13*c* by the amount corresponding to a time difference of +1 hour, that is, to the following time difference display position (step S33). For example, when the second hand 13*c* has stopped at the 0-second position, the second hand 13*c* is moved clockwise to the 3-second position. When a negative time difference is considered, the second hand 13*c* may be moved stepwise by the time difference of +1 hour to the 32-second position, which corresponds to a time difference of +13 hours, and the second hand 13*c* may further be moved clockwise to the 33-second position, which corresponds to a time difference of −11 hours, and then moved stepwise by a time difference of −1 hour whenever the operation button 17 is pressed. When the crown 16 and the operation button 17 are pressed at the same time, the second hand 13*c* may be directly moved to the 33-second position, which corresponds to the time difference of −11 hours.

Having moved the second hand 13*c* by the amount corresponding to the time difference of +1 hour or the amount corresponding to the time difference of −1 hour, the time difference correction mode processor 421 evaluates whether one minute has elapsed (step S34). When a result of the evaluation shows that one minute has not elapsed (NO in step S34), the time difference correction mode processor 421 evaluates whether the operation button 17 has been pressed again (step S35). When the operation button 17 has been pressed again (YES in step S35) and the pressing operation period is shorter than three seconds (NO in step S32), the time difference correction mode processor 421 moves the second hand 13*c* by the amount corresponding to the time difference of +1 hour or the amount corresponding to the time difference of −1 hour (step S33). As described above, in the present embodiment, when the operation button 17 is pressed for a period shorter than three seconds after the second hand 13*c* stops at the position of the currently set time difference, the time difference correction in related art in which the second hand 13*c* is moved by the amount corresponding to the time difference of one hour whenever the operation button 17 is pressed once can be performed.

When a result of the evaluation shows that one minute has elapsed after the second hand 13*c* was moved by the amount corresponding to the time difference of one hour (YES in step S34), the time difference correction mode processor 421 reads the time difference from the time difference display position to which the second hand 13*c* was moved and stores the read time difference as the time difference set value in the time difference set value storage section 422 (step S17). The time difference correction mode processor 421 then causes the time display controller 410 to start the normal time display and switches the action mode to the normal time display mode (step S18).

On the other hand, when a result of the evaluation shows that the operation button 17 has been pressed for a period longer than or equal to three seconds after the second hand 13*c* stopped at the position of the currently set time difference (YES in step S12, YES in step S30, YES in step S32) or when a result of the evaluation shows that the operation button 17 has been pressed for a period longer than or equal to three seconds after the second hand 13*c* was moved by the amount corresponding to the time difference of one hour (NO in step S34, YES in step S35, YES in step S32), the time difference correction mode processor 421 moves the second hand 13*c* stepwise to the time difference display positions to continuously display the time difference correction candidates (step S13), as in the first embodiment. No description will be made of the following processes because they are the same as those in the first embodiment.

As described above, the present embodiment allows the following two types of time difference correction in accordance with the length of the period for which the operation button 17 is pressed: the time difference correction in which the second hand 13*c* is moved by the amount corresponding to the time difference of one hour whenever the operation button 17 is pressed once; and the time difference correction in which when the operation button 17 is pressed for a period longer than or equal to three seconds, the second hand 13*c* is moved stepwise to time difference display positions to continuously display time difference correction candidates. Therefore, according to the present embodiment, for example, when a small time difference is considered, the time difference correction in which the second hand 13*c* is moved by the amount corresponding to the time difference of one hour whenever the operation button 17 is pressed once can be selected, whereas when a large time difference is considered, the time difference correction in which the second hand 13*c* is moved stepwise can be selected, whereby the time difference correction operation is improved in terms of convenience.

Fourth Embodiment

A fourth embodiment of the invention will be described with reference to FIG. 9. In the third embodiment, the description has been made of the case where the following two types of time difference correction are allowed: the time difference correction in which the second hand 13*c* is moved by the amount corresponding to the time difference of one hour whenever the operation button 17 is pressed once; and the time difference correction in which when the operation button 17 is pressed for a period longer than or equal to three seconds, the second hand 13*c* is continuously moved through time difference display positions but caused to stop at each of the time difference display positions for a predetermined period. The present embodiment differs from the third embodiment in that the following two types of time difference correction are allowed: the time difference correction in which the second hand 13*c* is moved by the amount corresponding to the time difference of one hour whenever the operation button 17 is pressed once; and time difference correction in which when the operation button 17 is pressed for a period longer than or equal to three seconds, the second hand 13*c* is continuously and smoothly moved through time difference display positions without causing the second hand 13*c* to stop at each of the time difference display positions for a predetermined period.

Figure 9:
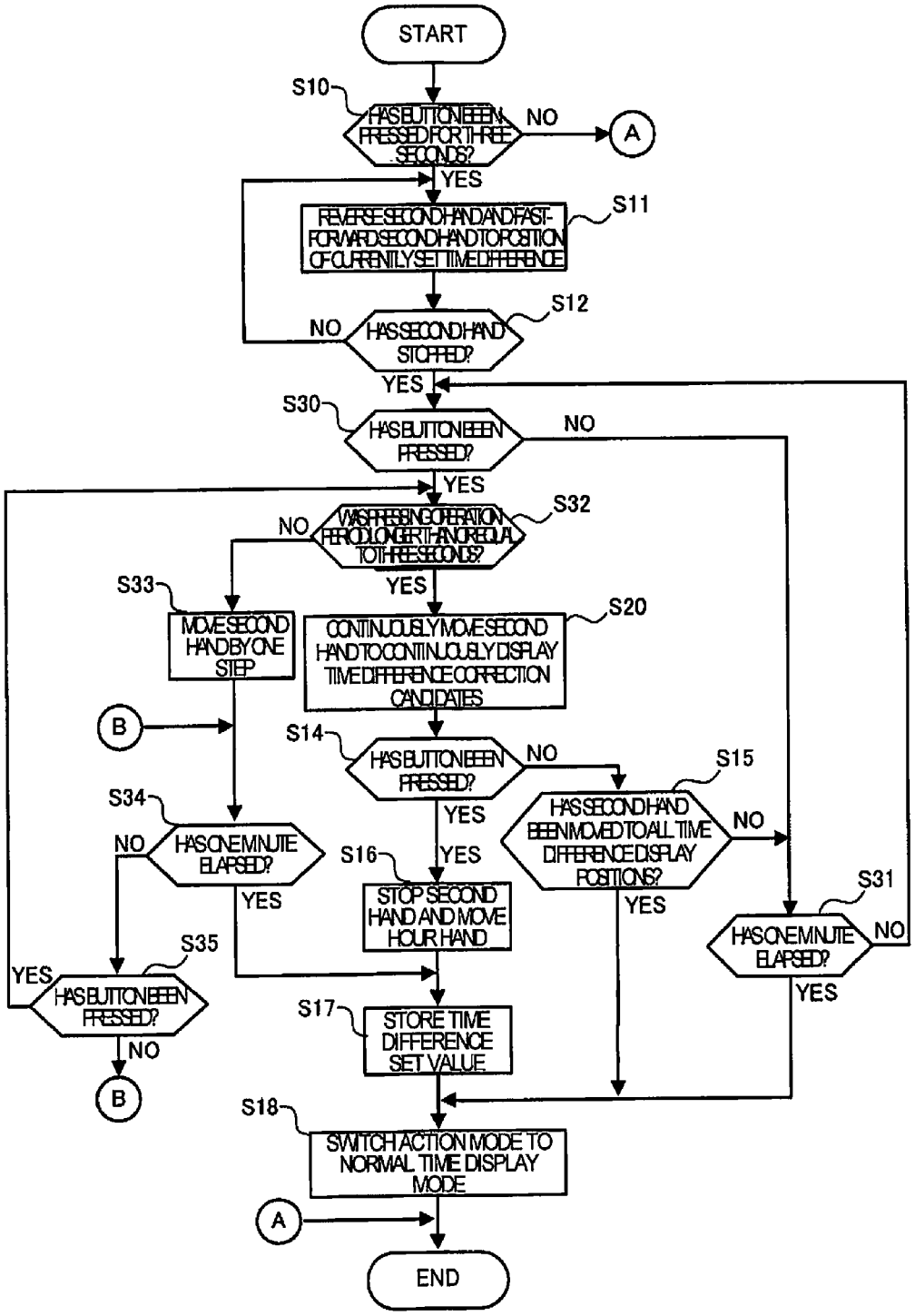
FIG. 9 is a flowchart showing action of an electronic timepiece according to a fourth embodiment of the invention that performs time difference correction.

FIG. 9 is a flowchart of the time difference correction mode in the present embodiment. In FIG. 9, the same processes as those in the third and second embodiments have the same step numbers. In the present embodiment, step S13 in the flowchart shown in FIG. 8 is replaced with step S20. The action in step S20 is the same as the continuous movement action in the second embodiment shown in FIG. 6.

Therefore, when a result of the evaluation shows that the operation button 17 has been pressed for a period longer than or equal to three seconds after the second hand 13*c* stopped at the position of the currently set time difference, (YES in step S12, YES in step S30, YES in step 32) or when a result of the evaluation shows that the operation button 17 has been pressed for a period longer than or equal to three seconds after the second hand 13*c* was moved by the amount corresponding to the time difference of one hour (NO in step S34, YES in step S35, YES in step 32), the time difference correction mode processor 421 continuously moves the second hand 13*c* to cause it to continuously display the time difference correction candidates (step S20), as in the second embodiment. No description will be made of the following processes because they are the same as those in the second and third embodiments.

As described above, the present embodiment allows the following two types of time difference correction in accordance with the length of the period for which the operation button 17 is pressed: the time difference correction in which the second hand 13*c* is moved by the amount corresponding to the time difference of one hour whenever the operation button 17 is pressed once; and the time difference correction in which when the operation button 17 is pressed for a period longer than or equal to three seconds, the second hand 13*c* is continuously moved to continuously display time difference correction candidates. Therefore, according to the present embodiment, for example, when a small time difference is considered, the time difference correction in which the second hand 13*c* is moved by the amount corresponding to the time difference of one hour whenever the operation button 17 is pressed once can be selected, whereas when a large time difference is considered, the time difference correction in which the second hand 13*c* is continuously moved can be selected, whereby the time difference correction operation is improved in terms of convenience.

Variations

The invention is not limited to the embodiments described above, and a variety of variations, for example, those that will be described below, are conceivable. Further, one or more arbitrarily selected aspects of the variations that will be described below can be combined with each other as appropriate.

Variation 1

Figure 10:
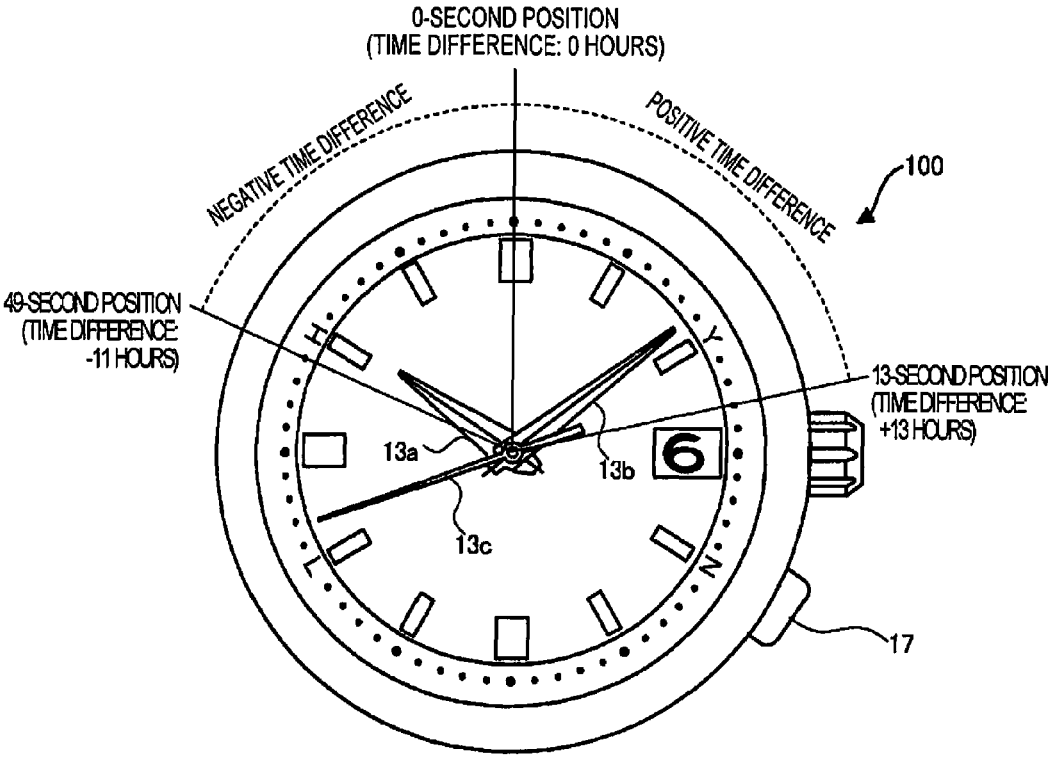
FIG. 10 shows time difference display positions in a variation of the invention.

In each of the embodiments described above, the time difference display positions are positions which are defined by replacing a time difference of one hour with three or two seconds and to which the second hand is moved clockwise from the 0-second position. The invention is, however, not limited to the example described above. For example, the time difference of one hour may be replaced with one second, and when a positive time difference is considered, the time difference display positions may be positions to which the second hand is moved from the 0-second position to a 13-second position, and when a negative time difference is considered, the time difference display positions may be positions to which the second hand is moved from the 0-second position to a 49-second position, as shown in FIG. 10. In this case, the time difference table 423 only needs to store the relationship between time differences and time difference display positions shown in FIG. 11 by way of example. Further, in this case, the position from which the continuous action of the second hand 13*c* starts may be the 49-second position or the 13-second position. It is further noted that the time difference display positions are not limited to those described above and can be set as appropriate.

Variation 2

Figure 12:
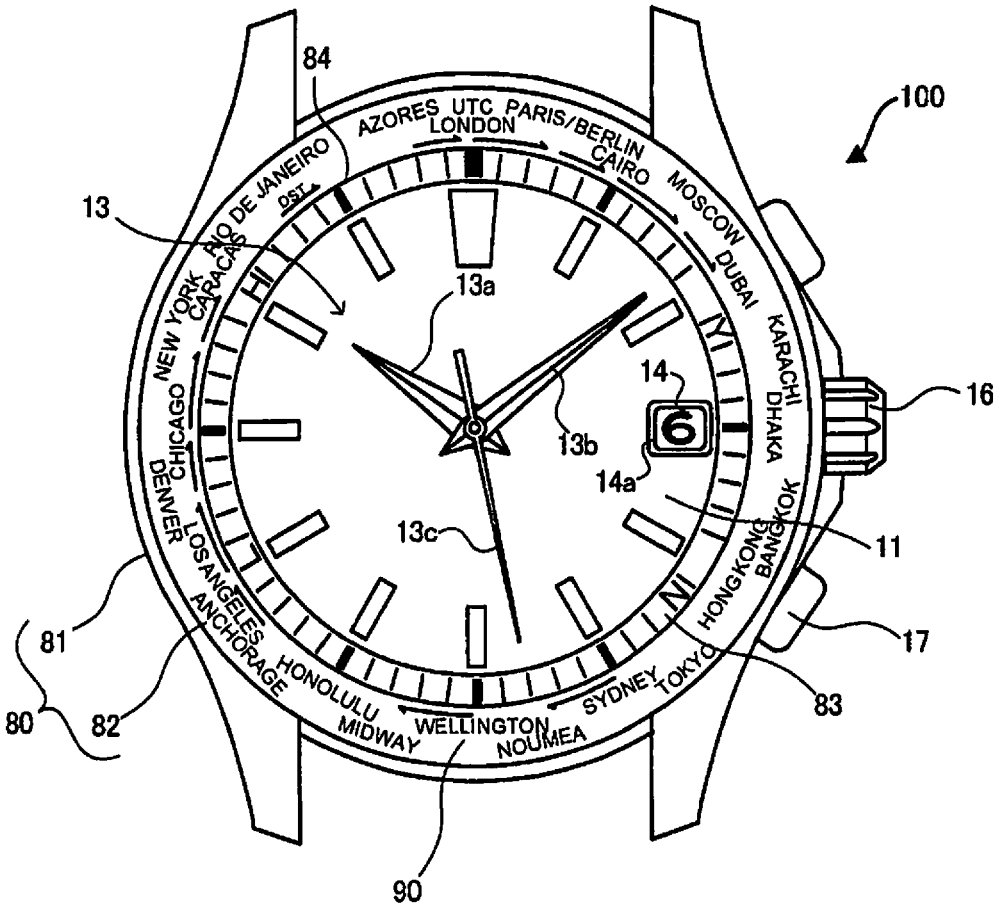
FIG. 12 shows time difference display positions using city names in a variation of the invention.

In each of the embodiments and the variation described above, the markings for time display are used as the time difference display positions. The invention is, however, not limited to the example described above. For example, as shown in FIG. 12, city names 90 may be displayed on the bezel 82, and the displayed city names 90 may be used as the time difference display positions. In this case, the time difference table 423 only needs to store time positions (such as 0-second position and 15-second position, for example) corresponding to the positions of the city names and the relationship between each of the city names and time difference. The member on which the city names 90 are displayed is not limited to the bezel 82 and may instead be the dial 11, the cover glass plate 84, the dial ring 83, or any other component.

Variation 3

In each of the embodiments and the variations described above, the description has been made of a radio-wave-based correction timepiece including the reception unit that receives the standard radio wave. Instead, an electronic timepiece having no radio wave reception function may be used. Further, the invention is not limited to an analog electronic timepiece and is applicable to a digital electronic timepiece, a quartz watch, a table clock, a wall clock, or any other timepiece.

Variation 4

In each of the embodiments and the variations described above, the time difference setting is made on a one-hour basis, but the invention is not limited to the example described above. For example, the time difference setting may be made on a 30-minute basis.

Variation 5

In each of the embodiments and the variations described above, the description has been made of the case where when the action mode is switched to the time difference correction mode, the second hand 13*c* is moved to the position of the time difference set value stored in the time difference set value storage section 422. Instead, when the action mode is switched from the normal time display mode to the time difference correction mode, the time difference set value stored in the time difference set value storage section 422 may be reset, and the second hand 13*c* may always be moved to the 0-second position.

Variation 6

In each of the embodiments and the variations described above, the description has been made of the case where in the time difference correction mode, the second hand 13*c* points at time difference display positions. Instead, the hour hand 13*a* or the minute hand 13*b* may point at the time difference display positions. Still instead, an appropriate combination of the second hand 13*c*, the hour hand 13*a*, and the minute hand 13*b* may be used to point at the time difference display positions. Further, negative numerals may be printed on the date indicator 14 as well as the date display, and the thus configured date indicator may be used.

Each of the functions in the invention described above or the function of each of the controllers in the central control unit 400 may be achieved by installing a control program in a computer including a CPU (central processing unit), a memory (storage unit), and other components, and causing the computer to function, for example, as the time difference correction mode processor 421, the time difference set value storage section 422, or the time difference table 423 allows a variety of types of correction, changes in settings, and other types of operation to be readily performed. The control program may be installed via the Internet or any other communication tool or a CD-ROM, a memory card, or any other recording medium.

This application claims priority to Japanese Patent Application No. 2014-059911 filed on Mar. 24, 2014. The entire disclosure of Japanese Patent Application No. 2014-059911 is hereby incorporated herein by reference.

What is claimed is:

1. An electronic timepiece comprising:

a display section;

an input section;

a time difference correction control section that performs time difference correction in accordance with an input placed at the input section; and a time display control section that causes the display section to display time-difference time produced by adding a time difference set value to current time, wherein the time difference correction control section causes the display section to continuously display a plurality of time difference correction candidates when the input is placed once at the input section, whereas when the input is placed again at the input section, the time difference correction control section corrects the time difference set value to a time difference of the time difference correction candidate displayed when the input is placed again.

2. The electronic timepiece according to claim 1, wherein the display section includes a time indicating hand and time display markings, and the time difference correction control section moves the time indicating hand stepwise to the positions of the time display markings to cause the time indicating hand to display the time difference correction candidates.

3. The electronic timepiece according to claim 1, wherein the display section includes a time indicating hand and time display markings, and the time difference correction control section continuously moves the time indicating hand in such a way that the time indicating hand points at the time display markings to cause the time indicating hand to display the time difference correction candidates.

4. The electronic timepiece according to claim 1, wherein the input placed at the input section includes a first input and a second input having aspects different from each other, and when the input is the first input, the time difference correction control section causes the display section to continuously display the plurality of time difference correction candidates in response to the input placed once, whereas when the input is the second input, the time difference correction control section causes the display section to display one of the time difference correction candidates in response to the input placed once.

5. A time difference correction method comprising:

causing a display section to display time-difference time produced by adding a time difference set value to current time;

performing time difference correction in accordance with an input placed at an input section; and causing the display section to continuously display a plurality of time difference correction candidates when the input is placed once at the input section, whereas when the input is placed again at the input section, correcting the time difference set value to a time difference of the time difference correction candidate displayed when the input is placed again.

* * * * *